US010712140B2

(12) United States Patent
Sasnett et al.

(10) Patent No.: US 10,712,140 B2
(45) Date of Patent: Jul. 14, 2020

(54) BUMPER SYSTEM FOR AN EXPLOSIVE ORDNANCE DISPOSAL DISRUPTOR

(71) Applicant: Zero Point, Incorporated, Virginia Beach, VA (US)

(72) Inventors: Perry Allen Sasnett, Virginia Beach, VA (US); Michael Danforth Lincoln, Litchfield, NH (US); Joshua Keith Brammer, Virginia Beach, VA (US)

(73) Assignee: Zero Point, Incorporated, Virginia Beach, VA (US)

( * ) Notice: Subject to any disclaimer, the term of this patent is extended or adjusted under 35 U.S.C. 154(b) by 0 days.

(21) Appl. No.: 15/916,693

(22) Filed: Mar. 9, 2018

(65) Prior Publication Data

US 2018/0259311 A1 Sep. 13, 2018

Related U.S. Application Data

(60) Provisional application No. 62/600,992, filed on Mar. 9, 2017.

(51) Int. Cl.
*F42B 33/06* (2006.01)

(52) U.S. Cl.
CPC ..... *F42B 33/06* (2013.01)

(58) Field of Classification Search
CPC ..... F42B 33/06
USPC ..... 86/50
See application file for complete search history.

(56) References Cited

U.S. PATENT DOCUMENTS 3,695,141 A * 10/1972 Kronman ..... F41F 1/00 89/1.14
3,724,372 A * 4/1973 Phillips ..... F42B 33/06 102/364
4,205,588 A * 6/1980 Phillips ..... F42B 33/06 521/159
4,779,511 A * 10/1988 Proctor ..... F42B 33/06 86/50
5,134,921 A * 8/1992 Breed ..... F41A 23/06 86/50
5,210,368 A * 5/1993 Heller, Jr. ..... F41A 19/59 42/84
5,386,758 A * 2/1995 Conley ..... F42B 33/06 86/50
5,460,154 A * 10/1995 Mattern ..... B09B 3/0058 124/56
5,474,114 A * 12/1995 Nickens ..... B09B 3/0058 141/330
5,664,610 A * 9/1997 Nickens ..... B09B 3/0058 141/1
5,736,669 A * 4/1998 Thomas ..... B09C 1/10 102/293
5,743,246 A * 4/1998 Mattern ..... B09B 3/0058 124/56

(Continued)

*Primary Examiner* — Michelle Clement
(74) *Attorney, Agent, or Firm* — Troutman Sanders LLP; James E. Schutz; Micah B. Hensley

(57) ABSTRACT

The disclosed technology includes a bumper system for use with an Explosive Ordnance Disposal disruptor. The bumper system can include a bumper stop configured the slidably engage the disruptor, and a bumper configured to receive at least a portion of an initiation system of the disruptor. The bumper may be configured to receive at least a portion of the initiation system such that the bumper is attached to the at least a portion of the initiation system by friction.

18 Claims, 6 Drawing Sheets

(56) References Cited

U.S. PATENT DOCUMENTS 6,120,627 A * 9/2000 Badger ..... B09C 1/10 149/108.8
6,490,957 B1 * 12/2002 Alexander ..... F41B 11/00 86/50
6,644,166 B2 * 11/2003 Alexander ..... F41B 11/00 86/50
7,299,735 B2 * 11/2007 Alford ..... F42B 33/062 86/43
7,533,597 B1 * 5/2009 Strohman ..... F16C 11/10 403/150
7,997,179 B1 * 8/2011 Nelson ..... F41A 11/02 181/110
8,006,621 B1 * 8/2011 Cherry ..... B26F 3/04 102/307
8,196,513 B1 * 6/2012 O'Rourke ..... F42B 12/204 102/475
8,245,430 B1 * 8/2012 Owenby ..... F41A 19/69 42/84
8,276,495 B1 * 10/2012 Chiu ..... F41A 21/485 42/1.08
9,127,920 B2 * 9/2015 Joseph ..... F42B 10/40
9,322,624 B2 * 4/2016 Alford ..... F41B 9/0046
9,347,728 B1 * 5/2016 Richwald ..... F41A 23/02
9,453,713 B1 * 9/2016 Langner ..... F42B 33/06
9,587,909 B1 * 3/2017 Askin ..... F41F 1/00
10,215,543 B1 * 2/2019 Benson ..... F42B 3/006
2008/0011152 A1 * 1/2008 Weiss ..... F41A 19/58 86/50
2008/0028921 A1 * 2/2008 Bitar ..... F42B 33/06 86/50
2009/0178548 A1 * 7/2009 Tyas ..... F41B 9/0046 86/50
2012/0017750 A1 * 1/2012 Koide ..... F42B 33/06 86/50
2012/0017752 A1 * 1/2012 Koide ..... C06B 21/0091 86/50
2012/0031258 A1 * 2/2012 Koide ..... F42D 5/04 86/50
2012/0137860 A1 * 6/2012 Koide ..... F42D 5/04 86/50
2013/0160635 A1 * 6/2013 Ueda ..... F42B 33/06 86/50
2014/0224101 A1 * 8/2014 Benson ..... F42B 1/02 86/50
2014/0238222 A1 * 8/2014 McKay ..... F41H 11/12 89/1.13
2014/0352522 A1 * 12/2014 Hayashi ..... F42D 3/00 86/50
2015/0040745 A1 * 2/2015 Joseph ..... F42B 10/40 86/50
2017/0138713 A1 * 5/2017 Penrod ..... F41B 9/0046
2017/0343323 A1 * 11/2017 Burmeister ..... F41H 7/005

* cited by examiner

BUMPER SYSTEM FOR AN EXPLOSIVE ORDNANCE DISPOSAL DISRUPTOR

CROSS-REFERENCE TO RELATED APPLICATIONS

This application claims priority to, and the benefit under 35 U.S.C. § 119(e), of U.S. Provisional Patent Application No. 62/600,992, filed 9 Mar. 2017, the entire contents and substance of which are hereby incorporated by reference as if fully set forth below.

BACKGROUND

Explosive Ordnance Disposal (EOD), sometimes referred to as bomb disposal, generally refers to systems and methods aiming to thwart or disrupt an explosive device, such that the explosive device is prevented from fully exploding. Certain systems may achieve this by targeting a specific portion or component of the explosive device with a disruptor device and discharging one or more projectiles from the disruptor device such that the explosive device is rendered inoperable, thus preventing the explosive device from exploding (e.g., discharging a 12-gauge disruption projectile, such as from the Zero Point TiTAN). Discharging a disruption projectile, however, causes a substantial amount of recoil, which may have energy levels upwards of 600 ft·lbf. To prevent injury to persons and/or damage to surrounding property or the disruptor itself, some systems may include a device or apparatus that has sufficient mass to absorb much of the recoil energy of the disruptor. For example, some systems may include a heavy robot or a large stand to which the disruptor is secured. In such systems, the robot or large stand can be capable of absorbing enough energy from the recoil such that the disruptor, robot, and/or stand are not launched at surrounding persons or objects. While proving useful for the absorption of recoil energy, the large amount of mass associated with such a system can cause the system to be inappropriate or unavailable under certain circumstances, such tactical situations requiring a relatively high level of mobility.

To address situations in which mobility is desirable, some disruptor systems may include a lightweight stand, permitting a user to more easily carry or otherwise transport the disruptor system. A lightweight stand, however, provides little benefit in the way of absorbing recoil energy caused by discharge of the disruption projectile from the disruptor. In some systems including a lightweight stand, during the targeting and/or aiming of the disruptor, the disruptor can be connected to the stand such that during discharge of the disruption projectile, the disruptor is permitted to disconnect from the stand and is propelled away from the targeted explosive device and the stand. In some systems, a stand—even a lightweight stand—may not be a practical option and a field expedient emplacement (e.g., a sand bag, a chair, a pillow, one or more blankets, or other quickly attainable items) may be used. In some systems, neither a stand nor an emplacement is used, and the disruptor may be set on the ground. Typically, during operation of a disruptor, the area is cleared of persons to alleviate concern that the disruptor may strike a person, but this may not always be practical or possible. During dismounted situations, it may also be typical for an operator to place a stopping object behind the disruptor to prevent the disruptor from impacting surrounding objects. For example, a large tire, a large piece of wood, a large rock, or one or more cinder blocks may be placed behind the disruptor. This may prevent the disruptor from being launched at other objects but may also increase the risk of damage to the disruptor itself. Even in scenarios in which an object is not placed behind the disruptor, the disruptor may be launched into the ground upon discharge, which can result in critical components of the disruptor becoming damaged or packed with dirt. As some disruptor systems are designed to be reusable, this may prevent or delay subsequent use of the disruptor, which may be detrimental in situations in which timeliness is critical.

SUMMARY

These and other problems may be addressed by embodiments of the technology disclosed herein. Certain implementations include a bumper system for an Explosive Ordnance Disposal (EOD) disruptor.

According to some embodiments, a bumper system, which can be for use with an EOD disruptor, can comprise a bumper stop and a bumper. The bumper stop can be configured to receive at least a portion of the EOD disruptor. The bumper can have a bulbous portion and an initiator device hole extending into the bulbous portion, and the initiator device hole can be offset from a central axis of the bumper. The bumper can be configured to receive at least a portion of an initiation system of the EOD disruptor such that the bumper is connected to at least a portion of the initiation system by friction.

In some embodiments, the initiator device hole can be offset from the central axis of the bumper by approximately 50°.

In some embodiments, the bumper can further comprise a protrusion, and the protrusion can be approximately cylindrical. The bumper stop can have an outer diameter that is greater than the outer diameter of the protrusion, and the bumper stop can further comprise a receiving hole formed partially therethrough. The receiving hole can have a diameter approximately equal to the outer diameter of the protrusion, and the receiving hole can be configured to receive at least a portion of the protrusion.

In some embodiments, the bumper can be configured to be retained at least partially by the bumper stop via friction between the receiving hole of the bumper stop and the protrusion of the bumper.

In some embodiments, the bumper can have an outer diameter that is less than an outer diameter of the bumper such that an external lip of the bumper is formed.

In some embodiments, the protrusion can taper as the protrusion extends from the bulbous portion of the bumper.

In some embodiments, the protrusion can taper at an angle in the range of approximately 0.5° to approximately 10°.

In some embodiments, the bulbous portion of the bumper can have a shape that is approximately hemispherical or a portion of an approximately ovate or ovoidal shape.

In some embodiments, the bumper stop can further comprise an attachment point for a lanyard.

According to some embodiments, an EOD disruptor system can comprise an elongate disruptor having a front end and a rear end, and the disruptor can be configured to both receive a disruption projectile proximate the rear end and discharge the disruption projectile out the front end. The EOD disruptor system can further include a bumper stop that can have a hole therethrough, and the hole can be configured to receive a portion of the disruptor. The EOD disruptor system can also include an initiation system that can be configured to detachably attach to the disruptor, and the initiation system can have a diameter greater than a diameter of the bumper stop such that the initiation system can be configured to maintain connection between the bumper stop and the disruptor when the initiation system is attached to the disruptor. The EOD disruptor system can also include a bumper that can have a bulbous portion, a first hole formed partially therethrough, and a second hold formed entirely therethrough. The first hole and the second hole can be in fluid connection, and the first hole can have a diameter approximately equal to the diameter of the breech plug assembly.

In some embodiments, the second hole can be offset from a central axis of the bumper.

In some embodiments, the second hole can be offset from the central axis of the bumper by approximately 50°.

In some embodiments, the bumper can be configured to receive, via the first hole, at least a portion of the breech plug assembly, and the bumper can be retained by the at least a portion of the initiation system at least in part by friction.

In some embodiments, the bumper can further comprise a protrusion, and the protrusion can be approximately cylindrical and can have an outer diameter less than an outer diameter of the bumper such that an external lip of the bumper is formed. The bumper stop can have an outer diameter greater than the diameter of the protrusion, and the bumper stop can further comprise a receiving hole formed partially therethrough. The receiving hole can have a diameter approximately equal to the outer diameter of the protrusion and configured to receive at least a portion of the protrusion.

In some embodiments, the external lip of the bumper can be configured to abut at least a portion of a rear face of the bumper stop.

In some embodiments, the protrusion can taper as the protrusion extends from the bulbous portion of the bumper.

In some embodiments, the bulbous portion of the bumper can have a shape that is approximately hemispherical or a portion of an approximately ovate or ovoidal shape.

According to some embodiments, a bumper system, which can be for use with an EOD disruptor, can comprise a bumper stop having a first hole formed therethrough and a second hole formed partially therethrough. The second hole can have a diameter such that a lip is formed, and the first hole can be configured to slidably receive at least a portion of the EOD disruptor. The bumper system can also include a bumper having a bulbous portion, a first hole formed partially therethrough from an end of the bumper opposite the bulbous portion, and a second hole extending into the bumper from the bulbous portion. The second hole can be in fluid communication with the first hole and can have a central axis that is offset approximately 50° from a central axis of the bumper. The first hole of the bumper can have a diameter approximately equal to an outer diameter of a first end of an initiation system associated with the EOD disruptor, and the second hole of the bumper stop can have a diameter approximately equal to an outer diameter of a second end of the breech plug assembly. At least a portion of the bumper can be configured to abut at least a portion of the bumper stop, and the bumper and the bumper stop can be configured to, in combination, fully enclose the breech plug assembly.

Other embodiments, implementations, features, and aspects of the disclosed technology are described in detail herein and are considered a part of the disclosed technology. Other embodiments, implementations, features, and aspects can be understood with reference to the following detailed description, accompanying drawings, and claims.

BRIEF DESCRIPTION OF THE FIGURES

Reference will now be made to the accompanying figures, which are not necessarily drawn to scale, and wherein.

DETAILED DESCRIPTION

Throughout this disclosure, certain implementations are described in exemplary fashion in relation bumper systems, which can be used with stand-mounted EOD disruptor systems. But implementations of the disclosed technology are not so limited. In some implementations, the disclosed technology may be effective when used with any initiation system. Moreover, certain implementations may be effective at reducing recoil damage, regardless of whether the EOD disruptor system is mounted to a stand.

Some implementations of the disclosed technology will be described more fully hereinafter with reference to the accompanying drawings. This disclosed technology may, however, be embodied in many different forms and should not be construed as limited to the implementations set forth therein.

In the following description, numerous specific details are set forth. But it is to be understood that implementations of the disclosed technology may be practiced without these specific details. In other instances, well-known methods, structures, and techniques have not been shown in detail in order not to obscure an understanding of this description. References to "one implementation," "an implementation," "example implementation," "some implementations," "certain implementations," "various implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Figure 1A:
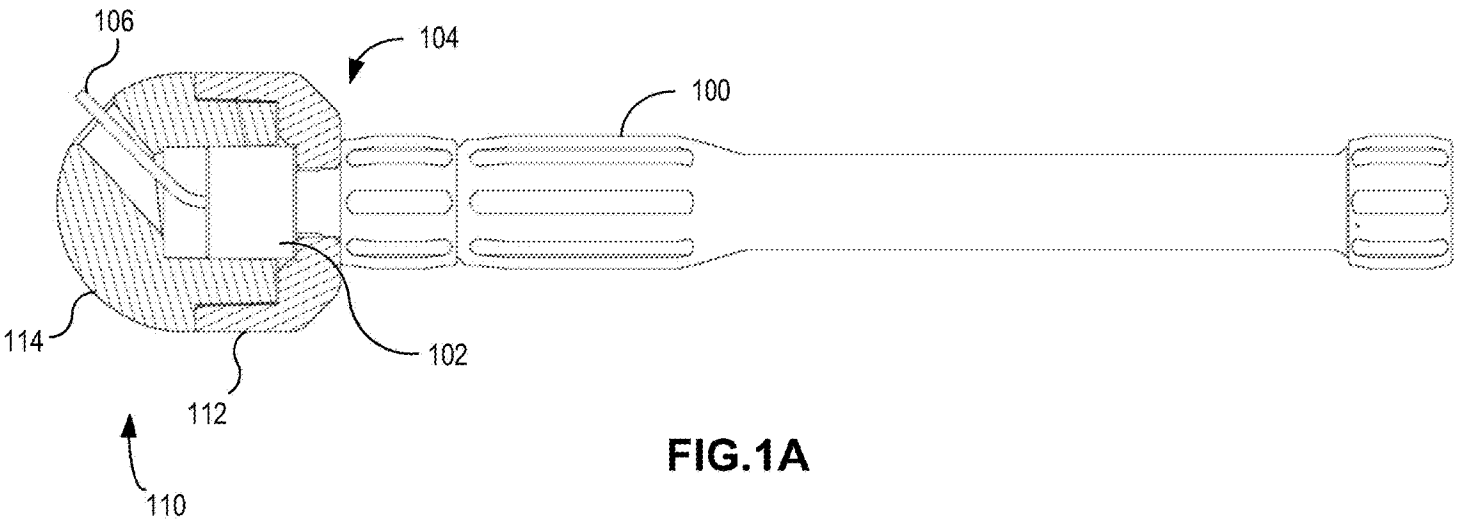
FIG. 1A depicts a partial cross-section of a disruptor including a bumper system, according to certain embodiments of the present disclosure.
Figure 1B:
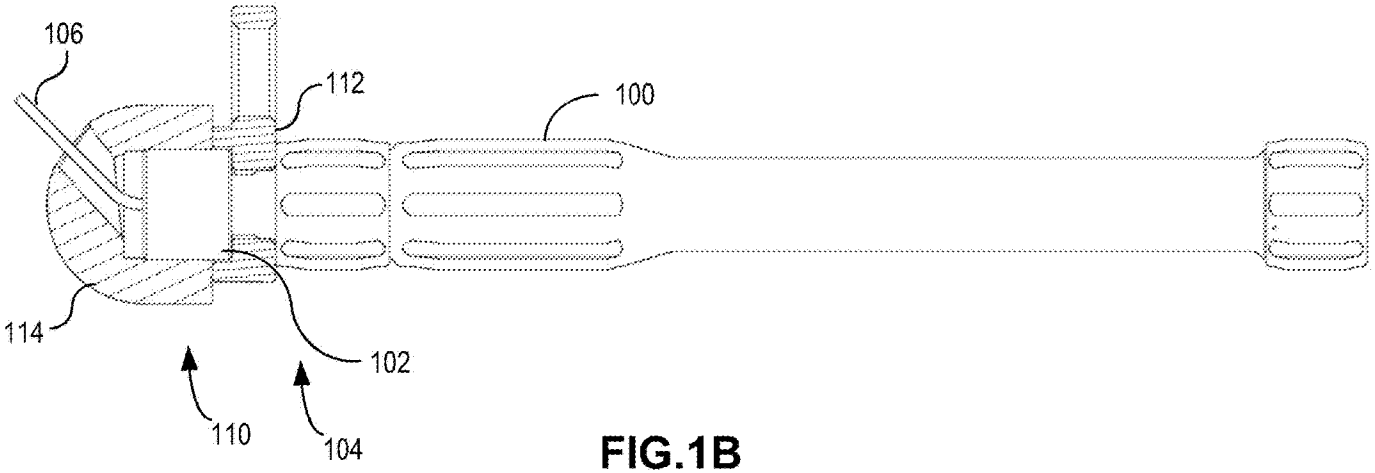
FIG. 1B depicts a partial cross-section of a disruptor including a bumper system, according to certain embodiments of the present disclosure.
Figure 2A:
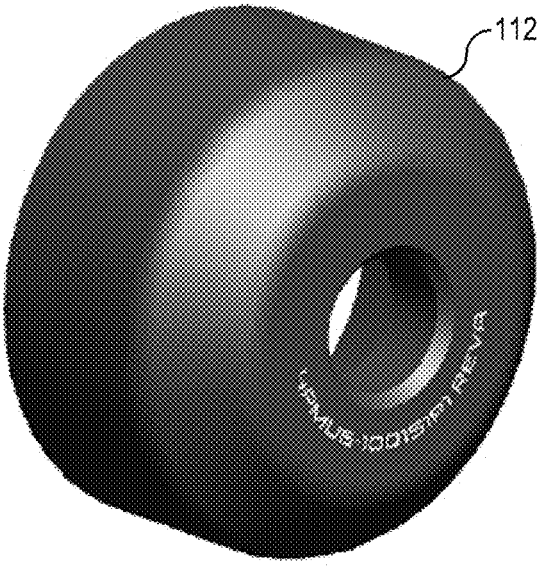
FIG. 2A depicts an isometric view of a bumper stop, according to certain embodiments of the present disclosure.
Figure 2B:
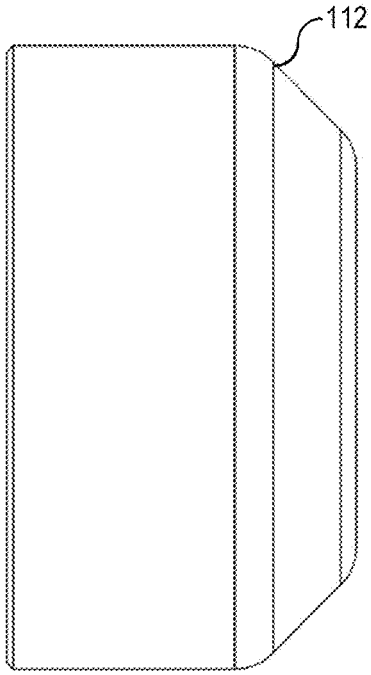
FIG. 2B depicts a side view of a bumper stop, according to certain embodiments of the present disclosure.
Figure 2C:
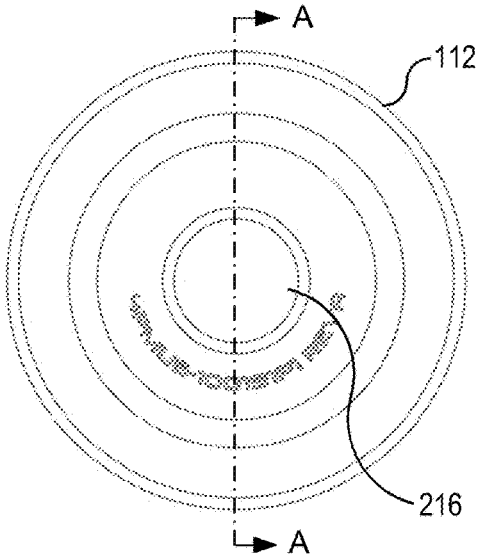
FIG. 2C depicts a front view of a bumper stop, according to certain embodiments of the present disclosure.
Figure 2D:
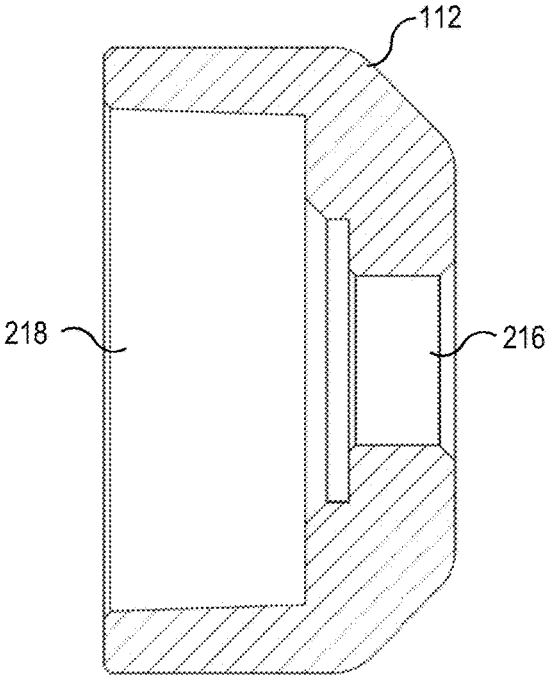
FIG. 2D depicts a cross-sectional view of a bumper stop taken along line A-A of FIG. 2C, according to certain embodiments of the present disclosure.
Figure 3A:
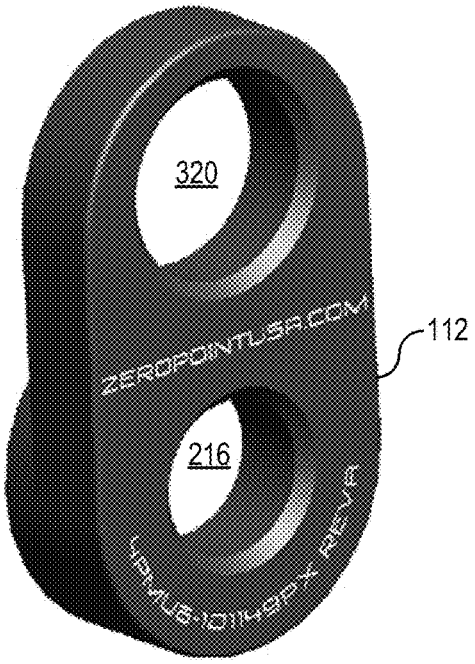
FIG. 3A depicts an isometric view of a bumper stop, according to certain embodiments of the present disclosure.
Figure 3B:
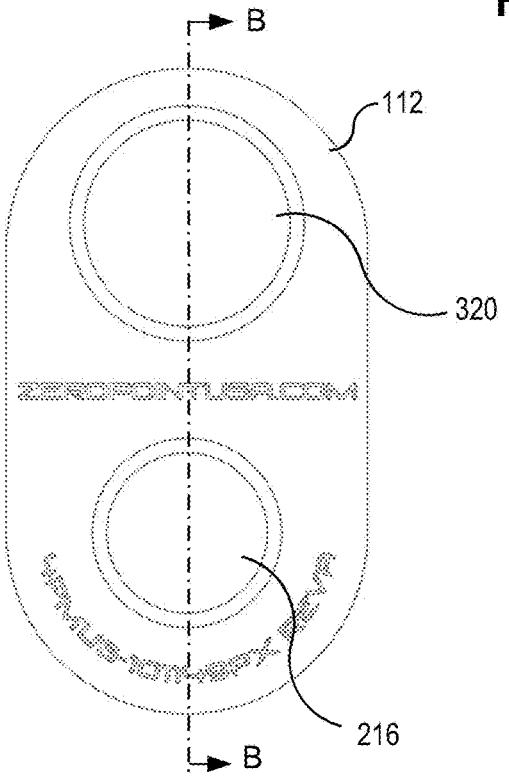
FIG. 3B depicts a front view of a bumper stop, according to certain embodiments of the present disclosure.
Figure 3C:
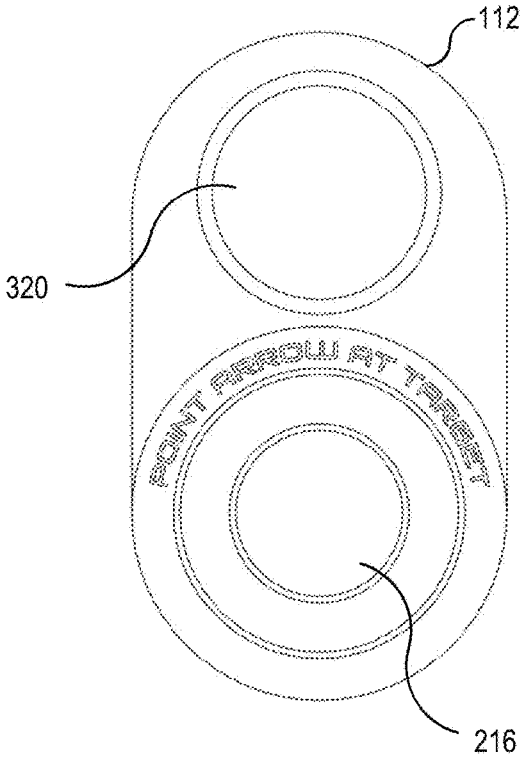
FIG. 3C depicts a rear view of a bumper stop, according to certain embodiments of the present disclosure.
Figure 3D:
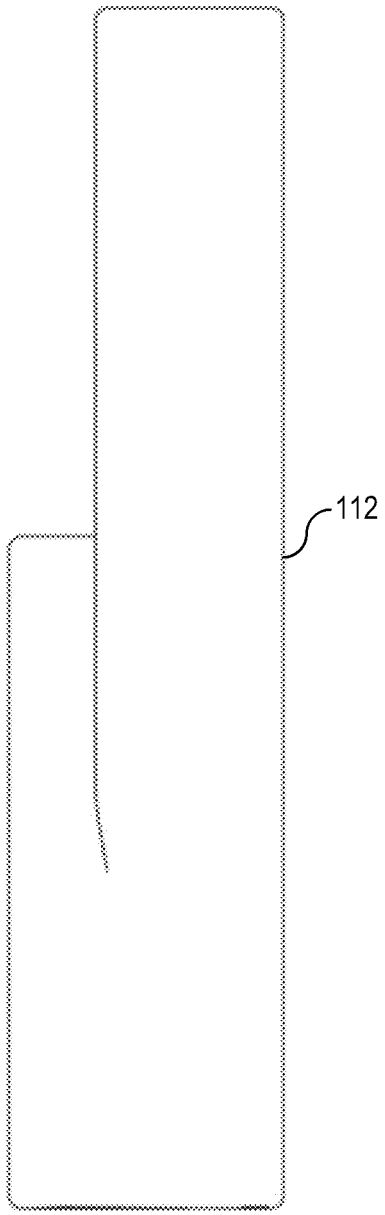
FIG. 3D depicts a side view of a bumper stop, according to certain embodiments of the present disclosure.
Figure 3E:
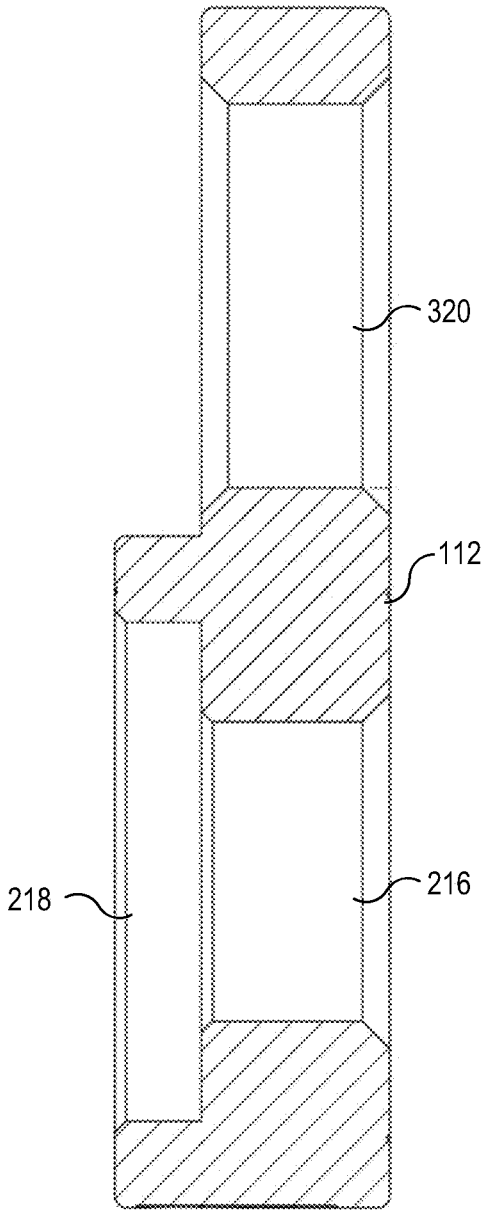
FIG. 3E depicts a cross-sectional view of a bumper stop taken along line B-B of FIG. 3B, according to certain embodiments of the present disclosure.
Figure 4A:
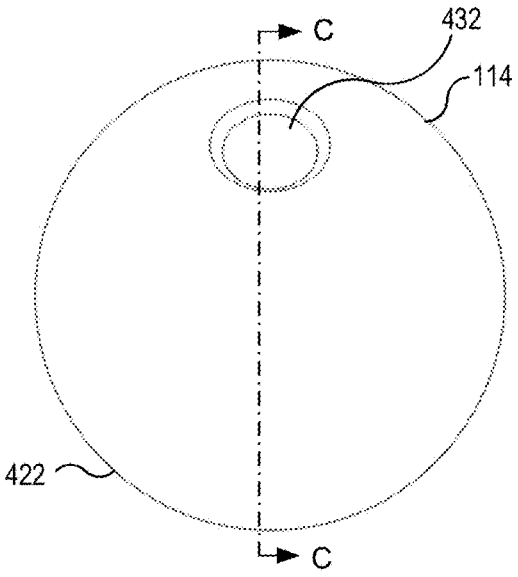
FIG. 4A depicts a rear view of a bumper, according to certain embodiments of the present disclosure.
Figure 4B:
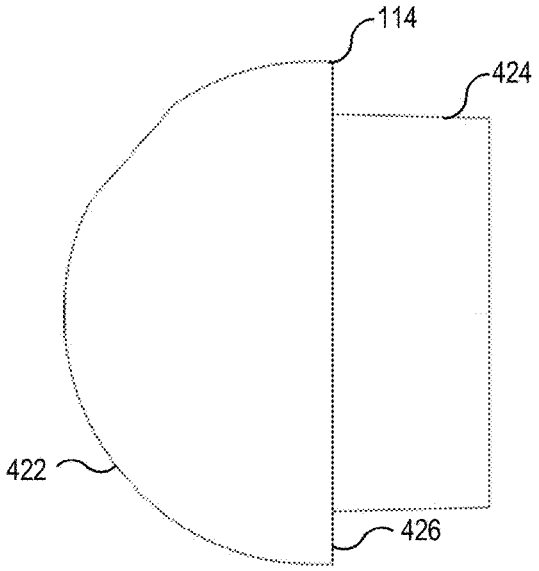
FIG. 4B depicts a side view of a bumper, according to certain embodiments of the present disclosure.
Figure 4C:
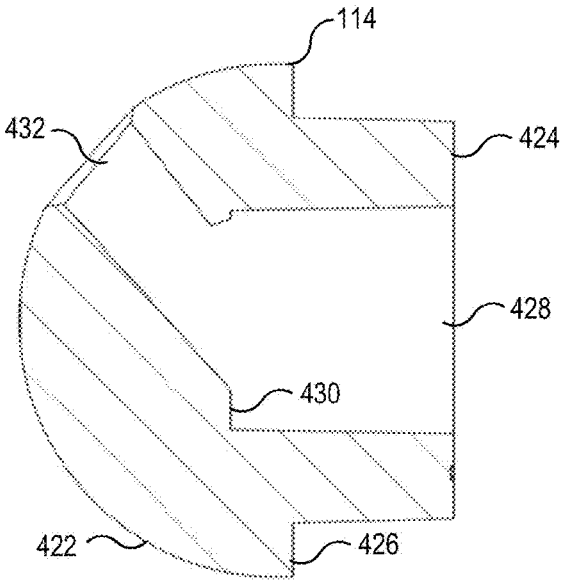
FIG. 4C depicts a cross-sectional view of a bumper stop taken along line C-C of FIG. 4A, according to certain embodiments of the present disclosure.
Figure 4D:
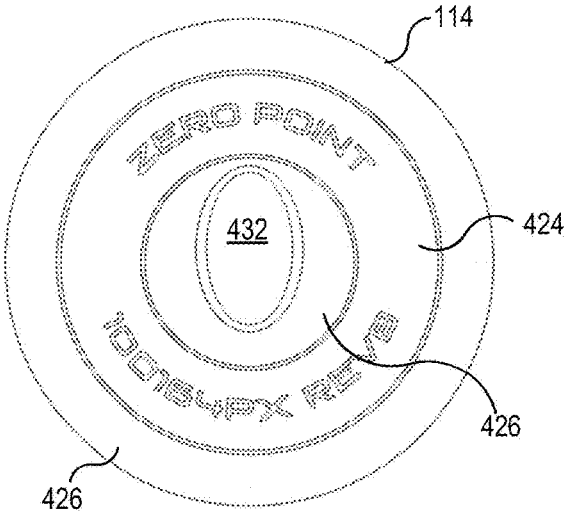
FIG. 4D depicts a front view of a bumper, according to certain embodiments of the present disclosure.
Figure 5A:
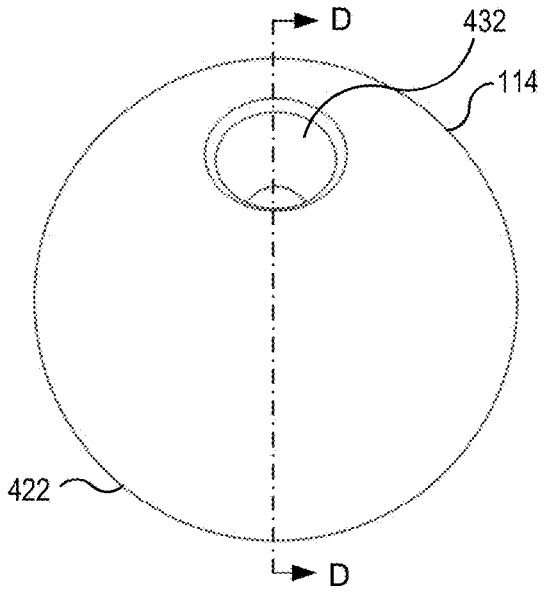
FIG. 5A depicts a rear view of a bumper, according to certain embodiments of the present disclosure.
Figure 5B:
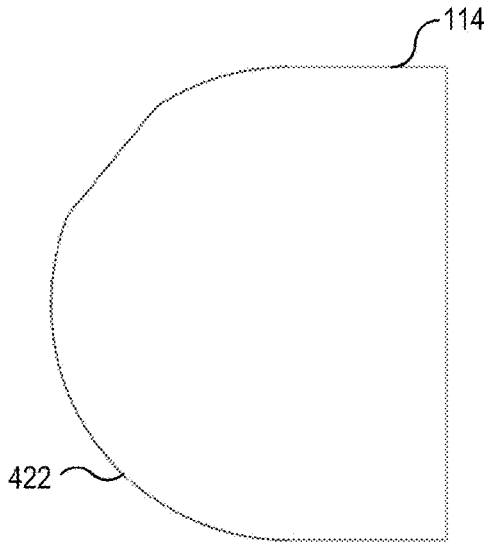
FIG. 5B depicts a side view of a bumper, according to certain embodiments of the present disclosure.
Figure 5C:
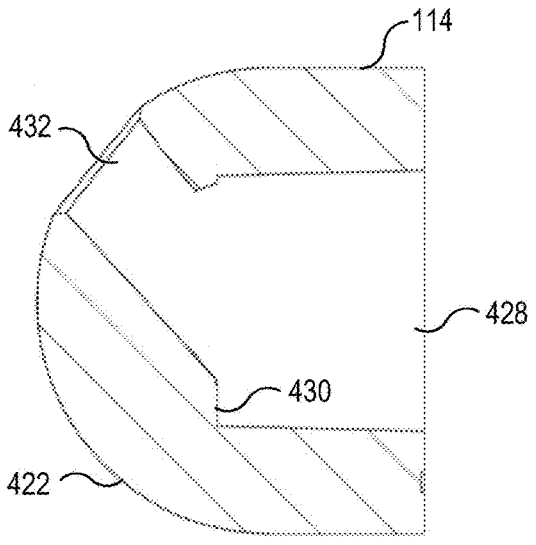
FIG. 5C depicts a cross-sectional view of a bumper stop taken along line C-C of FIG. 5A, according to certain embodiments of the present disclosure.
Figure 5D:
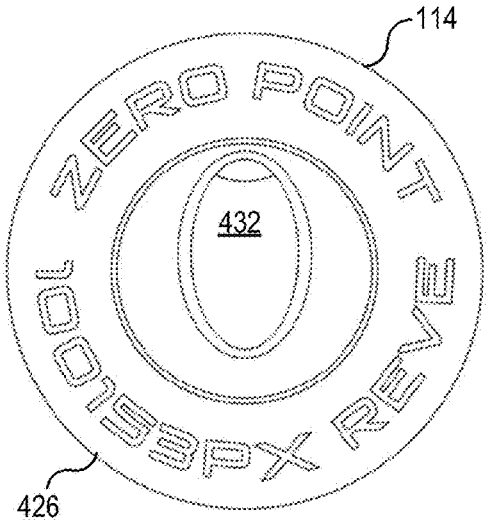
FIG. 5D depicts a front view of a bumper, according to certain embodiments of the present disclosure.

FIGS. 1A and 1B each depicts a disruptor 100 to which a bumper system 110 is attached. Typically, the disruptor includes an initiation system 102 (e.g., a breech plug assembly including a breech plug and firing pin, an electric firing system) that is located at or near the rear end 104 of the disruptor 100 and an initiator device 106 (e.g., an electric detonation transmitter, a shock tube, which is typically a piece of tubing including a small amount of explosive or other detonator material configured to engage an initiator, such as a firing pin, that is configured to initiate discharge of a disruption projectile) that is connected to the initiation system 102. In some disruptors 100, the initiation system 102 can include a push-lock device to permit easy attachment and detachment of the initiation device 106, for example.

Some disruptors 100 are designed to be reusable. To reuse some such disruptors 100, the spent disruption projectile must be replaced with a new disruption projectile, and a new initiator device 106 must be connected to the initiation system 102. As discussed above, the recoil experienced by a disruptor 100 upon discharge of a disruption projectile may cause the disruptor 100 to recoil away from the targeted explosive device and into an object located behind the disruptor 100. In an attempt to contain the disruptor 100 and prevent it from striking surrounding objects, an operator may place a stopping object, such as a makeshift wall or other items, behind the disruptor 100. While this may prevent the disruptor 100 from damaging surrounding persons or objects, this may increase the likelihood of the disruptor 100 itself suffering damage. Further, the initiation system 102—which is often one of the most expensive components of the disruptor 100 and typically critical to functionality of the disruptor 100—is often located at or near the rear end 104 of the disruptor 100, increasing the risk of damaging a critical and/or expensive component of the disruptor 100. And because the disruptor 100 cannot function without the initiation system 102, the disruptor 100 may be inoperable until the initiation system 102 is replaced. Moreover, the comparatively high price of an initiation system 102 may discourage an operator from storing extra or backup breech plug assemblies 102, resulting in the disruptor 100 being inoperable until a new initiation system is ordered, delivered, and installed. Even if the initiation system 102 is not broken during recoil, damage to the breech plug assembly, such as bending a portion of it, may make it difficult or impossible to remove and replace the spent initiator device 106 without fully disassembling the disruptor 100. This may prove catastrophic in an emergency situation.

To combat these problems, a bumper system 110 can be installed or attached to the disruptor 100 to protect the breech plug assembly. In some embodiments, the bumper system 110 can include a bumper stop 112 and a bumper 114. According to some embodiments, the bumper system 100 requires minimal effort to attach to and/or detach from the disruptor 100. This may enable an operator to quickly remove some or all of the bumper system 110 (as necessary) to access the initiation system 102 to remove and/or replace the spent initiator device 106 and/or the spent disruption projectile. The bumper 114 of the bumper system 110 may be configured to absorb at least a portion of the impact force resulting from recoil while being durable enough for repeated use. The bumper stop 112 of the bumper system 110 may be configured to provide a greater surface area for the bumper to press against upon impact, which may increase the durability of the bumper 114, the bumper system 110, and/or the disruptor 100 itself. Such a configuration may also protect any attachment mechanism used by the initiation system 102 and/or initiator device 106, such as a quick-release assembly. In some embodiments, the disruptor 100 may include an attachment point for a lanyard, such as a recoil arresting lanyard or a recoil absorbing lanyard. In certain embodiments, the lanyard attachment point may be attached, connected, and/or affixed to the bumper stop 112, and in some embodiments, the lanyard attachment point may be integral with the bumper stop 112, as depicted in FIG. 1B, for example. Various aspects of the bumper system 110 are discussed more fully below.

FIGS. 2A-2D depict a bumper stop 112 that, according to some embodiments, may be used with the disruptor shown in FIG. 1A. In some embodiments, the bumper stop 112 may include a through-hole 216. In some embodiments, the through-hole 216 may be coaxial with the center of the bumper stop 112. In some embodiments, the diameter of the through-hole 216 may be larger than the diameter of the rear end 104 of the disruptor 100. In certain embodiments, the diameter of the through-hole 216 may be slightly larger than the diameter of the rear end 104 of the disruptor 100 such that the bumper stop 112 snugly fits on the rear end 104 (but not so snug that it is difficult to remove, by hand, the bumper stop 112 from the rear end 104). In some embodiments, the diameter of the through-hole 216 may be larger than the diameter of the rear end 104 of the disruptor 100 such that there is a small amount of "play" between the bumper stop 112 and the rear end 104. Having "play" between the bumper stop 112 and the rear end 104 of the disruptor 100 may advantageously permit an operator to more quickly attach and/or detach the bumper stop 112. The intentional difference in diameter between the through-hole 216 of the bumper stop 112 and the rear end 104 of the disruptor 100 may also permit the bumper system 110 to be usable with a range of diameters, and thus a range of third-party disruptors. Some embodiments may include a partial hole 218 extending into the rear of the bumper stop 112. In certain embodiments, the diameter of the partial hole 218 may be larger than the diameter of the through-hole 216.

FIGS. 3A-3E depict a bumper stop 112 that may be used, for example, with the disruptor 100 shown in FIG. 1B. As shown in FIGS. 3A-3E, some embodiments may include a bumper stop 112 that is asymmetrical. For example, in some embodiments, the bumper stop 112 may include a lanyard hole 320. As shown, in FIGS. 3A-3E, the lanyard hole 320 may be a hole through an extension of the bumper stop 112 such that the lanyard hole 320 is adjacent to the through-hole 216. All embodiments are not so limited, however. For example, in some embodiments, the lanyard hole 320 may be a ring, a loop, or a portion of a loop, attached to an external wall of the bumper stop 112.

According to some embodiments, the bumper stop 112 can be made of aluminum. In some embodiments, the bumper stop 112 can be made of aircraft grade aluminum (e.g., 6061-T6 aluminum). In certain embodiments, the bumper stop 112 may of any material of suitable strength to withstand repeated impacts, such as steel, other metals, or strong and stiff plastics, which may or may not include enhancements such as carbon fiber reinforcement. In certain embodiments, the bumper stop 112 may include a coating or finishing. For example, some embodiments may include mil-std-8625 anodized finishing. The thickness of the bumper stop 112 may be determined to provide sufficient structure, rigidity, and durability to withstand repeated impacts caused by recoil. In some embodiments, the thickness of the bumper stop may be in the range of ¼" to ⅜". In some embodiments, the thickness of the bumper stop may be in the range of ⅜" to ¾", and in some embodiments, the thickness of the bumper stop may be in the range of ¾" to 1.5".

FIGS. 4A-4D depict a bumper 114 that may, for example, be used with the disruptor 100 shown in FIG. 1A. In some embodiments, the bumper 114 may include a bulbous portion 422 and a protrusion 424. In some embodiments, the bulbous portion 422 may be approximately hemispherical. In some embodiments, the bulbous portion may resemble a portion of an ovate or ovoidal shape. In certain embodiments, the protrusion 424 may be approximately cylindrical. In some embodiments, the protrusion may have a diameter that is less than a diameter of the bulbous portion such that an external lip 426 is formed. In certain embodiments, the external lip 426 may be configured to abut at least a portion of the bumper stop 112. In some embodiments, the protrusion 424 may have a diameter that is approximately the same as the diameter of the partial hole 218 of the bumper stop 112. In some embodiments, the protrusion 424 may have a height that is approximately the same or less than the depth of the partial hole 218 of the bumper stop 112. In certain embodiments, the protrusion 424 may taper by decreasing in diameter as it extends away from the bulbous portion 422. In some embodiments, the protrusion 424 may taper at an angle in the range of 0.5° to 10°. For example, in some embodiments, the protrusion 424 may taper at an angle of 1.5°.

According to some embodiments, the bumper 114 may include a partial hole 428 extending into the bumper 114 from the face of the protrusion 424, forming an interior lip. The interior lip 430 may be configured to, upon assembly of the bumper system, receive at least a portion of the initiation system 102 such that the initiation system 102 is encompassed by the bumper system 110. In some embodiments, the bumper 114 may include an initiator device hole 432. In some embodiments, the initiator device hole 432 may be configured to provide easy attachment of an initiator device 106, such as a length of shock tube, that can be used to initiate discharge of the disruption projectile. In some embodiments, the diameter of the initiator device hole 432 may be substantially larger than the typical diameter of the initiator device 106. For example, in some embodiments, the diameter of the initiator device hole 432 may be in the range of 1/10" to ⅜", and in some embodiments, the diameter of the initiator device hole 432 may be in the range of ⅜" to ½". In some embodiments, the diameter of the initiator device hole 432 may be in the range of ½" to ¾", and in some embodiments, the diameter of the initiator device hole 432 may be in the range of ¾" to 1". According to some embodiments, the axis of the initiator device hole 432 may be offset from the central axis of the bumper 114. Because the disruptor 100 and bumper system 110 are most likely to be propelled straight backward upon discharge, this offset may decrease the likelihood that dirt and debris (or amount of dirt and debris) entering the initiator device hole 432. This may in turn reduce or eliminate the amount of dirt and debris coming into contact with the initiation system 102. In some embodiments, the axis of the initiator device hole 432 may be offset from the central axis of the bumper 114 at an angle in the range of 10° to 80°. For example, in some embodiments, the axis of the initiator device hole 432 may be offset from the central axis of the bumper 114 at an angle of approximately 50°.

FIGS. 5A-5D depict a bumper 114 that may, for example, be used with the disruptor 100 shown in FIG. 1B. In some embodiments, the bumper 114 may include a bulbous portion 422 but may not include a protrusion 424. Thus, in some embodiments, the bumper 114 may also not include an external lip 426.

According to some embodiments, the bumper 114 can be made of a polymer or a polymer resin. In some embodiments, the bumper 114 can be made of high-density, impact-resistant polymer material, such as a urethane or a polyurethane elastomer. The thickness of the bumper 114 may be determined to provide sufficient structure, rigidity, and durability to withstand repeated impacts caused by recoil. In some embodiments, the thickness of the bumper 114 may be in the range of ¼" to ½". In some embodiments, the thickness of the bumper 114 may be in the range of ½" to 1". In some embodiments, the thickness of the bumper 114 may be in the range of 1" to 3".

Exemplary Use Cases

The following exemplary use cases describe examples of a typical user flow pattern. It is intended solely for explanatory purposes and not in limitation. To attach the bumper system to the disruptor, the rear end of the disruptor is slidably inserted into the through-hole of the bumper stop. A breech plug assembly is then inserted into the rear end of the disruptor and held in place by the push-lock device. Because the breech plug assembly has a larger diameter than that of the through-hole of the bumper stop, the bumper stop is attached to the disruptor. Shock tube is then fed through bumper via the initiator device hole, and the shock tube is connected to the breech plug assembly. The bumper is then pressed onto (or into, depending on the embodiment) the breech plug assembly and/or the bumper stop, causing the bumper to be attached to the breech plug assembly and/or the bumper stop via frictional forces.

To remove the bumper system from the disruptor, the bumper is pulled from the breech plug assembly and/or the bumper stop, and the push-lock of the breech plug assembly is then released by depressing the push-lock, such that the spent shock tube can be removed from the breech plug assembly. The disruptor is then uninserted from the through-hole of the bumper stop.

Although certain features of the above disclosure are discussed with respect to a breech plug assembly and/or electric firing system, it is to be understood that the disclosed technology can be used with any initiation system currently available or yet to become available. Similarly, while certain features of the above disclosure are discussed with respect to a shock tube and/or an electric detonation transmitter and/or a shock tube, it is to be understood that the disclosed technology can be used with any initiator device currently available or yet to become available.

While certain implementations of the disclosed technology have been described in connection with what is presently considered to be the most practical implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

We claim:

1. A bumper system for attachment to an Explosive Ordnance Disposal (EOD) disruptor, the bumper system comprising:

a bumper stop configured to receive at least a portion of the EOD disruptor; and a bumper having a bulbous portion and an initiator device hole extending into the bulbous portion and being offset from a central axis of the bumper, the bumper configured to receive at least a portion of an initiation system of the EOD disruptor such that the bumper is connected to the at least a portion of the initiation system by friction.

2. The bumper system of claim 1, wherein the initiator device hole is offset from the central axis of the bumper by approximately 50°.

3. The bumper system of claim 2, wherein the bumper further comprises a protrusion, the protrusion being approximately cylindrical, wherein the bumper stop has an outer diameter greater than an outer diameter of the protrusion and the bumper stop further comprises a receiving hole formed partially therethrough, the receiving hole having a diameter approximately equal to the outer diameter of the protrusion and configured to receive at least a portion of the protrusion.

4. The bumper system of claim 3, wherein the bumper is configured to be retained at least partially by the bumper stop via friction between the receiving hole of the bumper stop and the protrusion of the bumper.

5. The bumper system of claim 3, wherein the protrusion has an outer diameter less than an outer diameter of the bumper such that an external lip of the bumper is formed.

6. The bumper system of claim 3, wherein the protrusion tapers as the protrusion extends from the bulbous portion of the bumper.

7. The bumper system of claim 3, wherein the protrusion tapers at an angle in the range of approximately 0.5° to approximately 10°.

8. The bumper system of claim 1, wherein the bulbous portion of the bumper has a shape that is approximately hemispherical or a portion of an approximately ovate or ovoidal shape.

9. The bumper system of claim 1, wherein the bumper stop further comprises an attachment point for a lanyard.

10. An Explosive Ordnance Disposal (EOD) disruptor system comprising:

an elongate disruptor having a front end and a rear end, the disruptor configured to receive a disruption projectile proximate the rear end and to discharge the disruption projectile out the front end;

an initiation system configured to detachably attach to the disruptor; and a bumper system configured to attach to the disruptor, the bumper system comprising:

a bumper stop configured to receive at least a portion of the disruptor; and a bumper having a bulbous portion, a first hole formed partially therethrough, and a second hole formed entirely therethrough, the first hole and the second hole being in fluid connection and the first hole configured to receive at least a portion of the initiation system.

11. The EOD disruptor system of claim 10, wherein the second hole of the bumper is offset from a central axis of the bumper.

12. The EOD disruptor system of claim 11, wherein the second hole of the bumper is offset from the central axis of the bumper by approximately 50°.

13. The EOD disruptor system of claim 10, wherein the first hole of the bumper has a diameter approximately equal to an outer diameter of the initiation system such that the bumper is configured to be retained by the initiation system at least in part by friction.

14. The EOD disruptor system of claim 13, wherein the bumper further comprises a protrusion, the protrusion being approximately cylindrical and having an outer diameter less than an outer diameter of the bumper such that an external lip of the bumper is formed, wherein the bumper stop has an outer diameter greater than the outer diameter of the protrusion and the bumper stop further comprises a receiving hole formed partially therethrough, the receiving hole having a diameter approximately equal to or greater than the outer diameter of the protrusion and configured to receive at least a portion of the protrusion.

15. The EOD disruptor system of claim 14, wherein the external lip of the bumper is configured to abut at least a portion of a rear face of the bumper stop.

16. The EOD disruptor system of claim 13, wherein the protrusion tapers as the protrusion extends from the bulbous portion of the bumper.

17. The EOD disruptor system of claim 10, wherein the bulbous portion of the bumper has a shape that is approximately hemispherical or a portion of an approximately ovate or ovoidal shape.

18. A bumper system for attachment to an Explosive Ordnance Disposal (EOD) disruptor, the bumper system comprising:

a bumper stop having a first hole formed therethrough and a second hole formed partially therethrough, the second hole having a diameter greater than the first hole such that a lip is formed, wherein the first hole is configured to slidably receive at least a portion of the EOD disruptor; and a bumper having a bulbous portion, the bumper comprising a third hole formed partially therethrough from an end of the bumper opposite the bulbous portion and a fourth hole extending into the bumper from the bulbous portion, the fourth hole being in fluid communication with the third hole and having a central axis that is offset approximately 50° from a central axis of the bumper, wherein the third hole of the bumper has a diameter approximately equal to an outer diameter of an end of an initiation system associated with the EOD disruptor and the second hole of the bumper stop has a diameter approximately equal to an outer diameter of an end of a breech plug assembly, wherein at least a portion of the bumper is configured to abut at least a portion of the bumper stop, wherein the bumper and the bumper stop are configured to, in combination, fully enclose the breech plug assembly.

* * * * *